US008847762B2

(12) United States Patent
Lian et al.

(10) Patent No.: US 8,847,762 B2
(45) Date of Patent: Sep. 30, 2014

(54) SECURITY SYSTEM TAG MAGNETIC CLUTCH AND METHOD

(75) Inventors: Ming-Ren Lian, Boca Raton, FL (US); Justin Stewart, Boca Raton, FL (US); Hubert A. Patterson, Boca Raton, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 374 days.

(21) Appl. No.: 13/167,211

(22) Filed: Jun. 23, 2011

(65) Prior Publication Data

US 2012/0326871 A1 Dec. 27, 2012

(51) Int. Cl.

| | |
|---|---|
| ***G08B 13/14*** | (2006.01) |
| ***E05B 73/00*** | (2006.01) |
| ***G08B 13/24*** | (2006.01) |

(52) U.S. Cl.

CPC ..... *E05B 73/0017* (2013.01); *G08B 13/1463* (2013.01); *G08B 13/2434* (2013.01); *E05B 73/0052* (2013.01); *G08B 13/246* (2013.01)

USPC ..... 340/572.1; 340/10.1; 340/505

(58) Field of Classification Search

USPC ..... 340/572, 10, 505

See application file for complete search history.

(56) References Cited

U.S. PATENT DOCUMENTS

| | | | | |
|---|---|---|---|---|
| 5,979,196 | A | 11/1999 | Vanmoor | |
| 7,921,524 | B2 * | 4/2011 | Maurer | 24/303 |
| 7,973,661 | B2 * | 7/2011 | Copeland | 340/572.1 |
| 8,054,185 | B2 * | 11/2011 | Lian et al. | 340/572.9 |
| 2007/0182569 | A1 * | 8/2007 | Lynce et al. | 340/572.9 |
| 2009/0224918 | A1 * | 9/2009 | Copeland | 340/572.1 |
| 2009/0273422 | A1 * | 11/2009 | Fullerton et al. | 335/306 |
| 2010/0148969 | A1 * | 6/2010 | Lian et al. | 340/572.9 |
| 2011/0234405 | A1 * | 9/2011 | Wyatt et al. | 340/572.9 |
| 2013/0141242 | A1 * | 6/2013 | Ho | 340/572.1 |

FOREIGN PATENT DOCUMENTS

| | | | |
|---|---|---|---|
| EP | 1857622 | A2 | 9/2002 |
| WO | WO 2008/088681 | | 7/2008 |
| WO | WO 2009/146455 | A2 | 12/2009 |
| WO | WO 2010/005584 | A1 | 1/2010 |

OTHER PUBLICATIONS

EPO International Search Report dated Sep. 19, 2012 for corresponding appln PCT/US12/043120.

* cited by examiner

*Primary Examiner* — Travis Hunnings

(74) *Attorney, Agent, or Firm* — Alan M. Weisberg; Christopher & Weisberg, P.A.

(57) ABSTRACT

A tag having a magnetic clamp for use in securing an item in order to prevent the unauthorized removal of the item from, for example, a retail store. The magnetic tag includes an attachment element that secures the item to the tag. A clamp having a locking region secures the attachment element such that the item cannot be separated from the tag. A keyed magnetic element on the clamp includes one or more hard magnets, where each hard magnet has either an outward-facing north or south polarity. By applying a magnetic force to the magnets, the locking region moves away from the attachment element thus allowing the item to be removed from the tag. The arrangement of magnets operates as a "key" and only a detacher unit with an identical magnetic pattern can apply the requisite magnetic force to the magnets to disengage the clamp from the attachment element to allow removal of the tag from the item.

20 Claims, 4 Drawing Sheets

SECURITY SYSTEM TAG MAGNETIC CLUTCH AND METHOD

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to security systems and more specifically to a security tag having a magnetic clamp where the security tag may only be unlocked using a detacher that supplies a magnetic field with a specific polarity pattern.

BACKGROUND OF THE INVENTION

Electronic article surveillance ("EAS") systems are generally known in the art for the prevention or deterrence of unauthorized removal of articles from a controlled area. In a typical EAS system, EAS tags, markers and labels (collectively "tags") are designed to interact with an electromagnetic field located at the exits of the controlled area, such as a retail store. These EAS tags are attached to the articles to be protected. If an activated EAS tag is brought into the electromagnetic field or "detection zone," the presence of the tag is detected and appropriate action is taken, such as generating an alarm. For authorized removal of the article, the EAS tag can be deactivated, removed or passed around the electromagnetic field to prevent detection by the EAS system.

Radio-frequency identification ("RFID") systems are also generally known in the art and may be used for a number of applications, such as managing inventory, electronic access control, security systems, and automatic identification of cars on toll roads. An RFID system typically includes an RFID reader and an RFID device. The RFID reader may transmit a radio-frequency ("RF") carrier signal to the RFID device. The RFID device may respond to the carrier signal with a data signal encoded with information stored by the RFID device.

The market need for combining EAS and RFID functions in the retail environment is rapidly emerging. Many retail stores that now have EAS for shoplifting protection rely on bar code information for inventory control. RFID offers faster and more detailed inventory control over bar coding. Retail stores already pay a considerable amount for hard tags that are re-useable. Adding RFID technology to EAS hard tags can easily pay for the added cost due to improved productivity in inventory control as well as loss prevention. Thus, the emergence of combination EAS/RFID tags.

Reusable tags, whether they are EAS, RFID, combination EAS/RFID, or other types of security tags, are typically removed from their articles before the customer exits the store. The security tags are affixed to their article by a locking mechanism such as a clamp that retains an attachment element such as a pin, which prevents the article from unauthorized removal from the store. One type of clamp is a magnetic clamp that can be unlocked by a permanent magnet in a detacher unit. This disengages the attachment pin in the tag to allow the article to be removed.

The locking mechanism (such as a moving clamp or pin) is usually made with a magnetic material such as carbon steel.

Upon exposure to a magnetic field from a detacher unit, part of the clamp is attracted to the detacher. This magnetic force is used to unlock the pin from the tag housing thus allowing the item to which the tag was attached to be removed from the store without setting off an alarm. In order to prevent illegitimate tag detachment using a commonly available magnet, the tag's clamp is typically designed such that it can only be opened when exposed to an unusually high magnetic field. Thus, many detacher designers have created detacher units having a magnetic structure that are capable of producing high field strength. However, with the advancement of magnet technology, magnets possessing significant magnetic field strength can be obtained if the shoplifter puts his or her mind to the task. This allows shoplifters to conceal a high powered magnet, enter a store, and use the magnet to detach the.

Therefore, what is needed is a magnetic clamp and detaching arrangement that overcomes the above-described challenges.

SUMMARY OF THE INVENTION

The present invention advantageously provides a magnetic security tag for use in securing an item in order to prevent the unauthorized removal of the item. The magnetic tag includes a clamp having a locking region that secures an attachment element such that the item cannot be separated from the tag. A keyed magnetic element situated on the clamp includes one or more hard magnets, where each hard magnet has either an outward-facing north or south polarity. The arrangement of magnets operates as a "key" and only a detacher unit with a corresponding attracting or repelling keyed magnetic pattern can apply the requisite magnetic force to the clamp magnets to disengage the attachment element from the item. By applying a magnetic force on the magnets, the locking region moves away from the attachment element thus allowing the tag to be removed from the item.

In one aspect of the invention, a magnetic clamping device for securing an attachment element to an item is provided. The magnetic clamping device includes a clamp movable between a locked position and an unlocked position and a keyed magnetic element affixed to the clamp. The clamp moves from the locked position to the unlocked position when a keyed magnetic force corresponding to the keyed magnetic element is applied to the keyed magnetic element.

In another aspect, a security tag is provided where the security tag includes an attachment element. A housing has an attachment region and a clamping region. The attachment region is adapted to receive at least a portion of the attachment element. A clamp is within the clamping region. The clamp is movable between a locked position and an unlocked position. A keyed magnetic element is affixed to the clamp. The clamp moves from the locked position to the unlocked position when a keyed magnetic force corresponding to the keyed magnetic element is applied to the keyed magnetic element.

In yet another aspect, a security system is provided in which the security system includes a security tag and a tag detacher. The security tag includes a clamping device. The clamping device has a clamp movable between a locked position and an unlocked position. A keyed magnetic element is affixed to the clamp. The keyed magnetic element having a magnetic polarity pattern. The tag detacher includes a magnetic region. The magnetic region applies, to the keyed magnetic element, a keyed magnetic force corresponding to that keyed magnetic element. The magnetic force moves the clamp from the locked position to the unlocked position.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
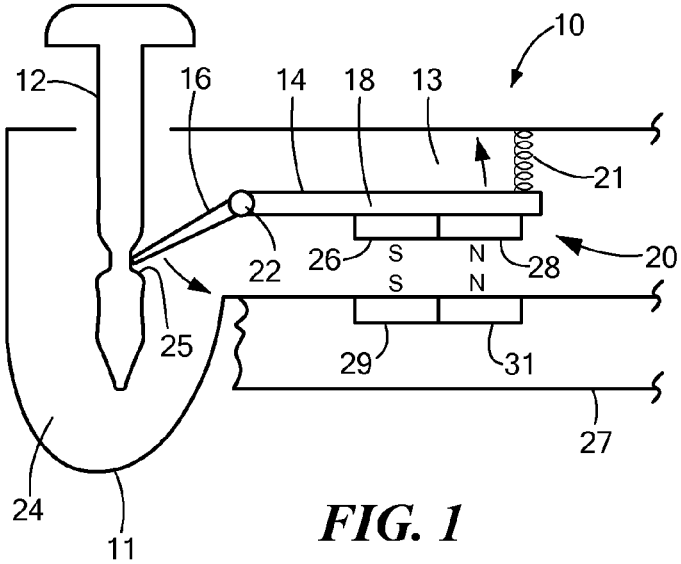
FIG. 1 is a side view of an exemplary magnetic tag constructed in accordance with the principles of the present invention.

Before describing in detail exemplary embodiments that are in accordance with the present invention, it is noted that the embodiments reside primarily in combinations of apparatus components related to providing a tag having a magnetic clamp for use in securing an item in order to prevent the unauthorized removal of the item.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a magnetic tag for use in securing an item, such as an article of clothing, in order to prevent the unauthorized removal of the item from, for example, a retail store. The magnetic tag includes an attachment element, such as a pin, or lanyard, that secures the item to the tag. A clamp having a pivoting or sliding portion secures the attachment element such that the item cannot be separated from the tag. A magnetic element is affixed to the clamp, and includes one or more hard magnets, where each hard magnet has either a north or south polarity. The arrangement of magnets operates as a "key" and only a detacher unit with a corresponding magnetic pattern can apply the magnetic attracting or repelling force to the magnets to disengage the attachment element from the tag. By applying a magnetic force to the magnets, the pivoting or sliding portion moves away from the attachment element thus allowing the attachment element to be removed from the tag.

The present disclosure will be understood more fully from the detailed description given below and from the accompanying drawings of particular embodiments of the invention which, however, should not be taken to limit the invention to a specific embodiment but are for explanatory purposes.

Numerous specific details may be set forth herein to provide a thorough understanding of a number of possible embodiments of a magnetic tag having one or more magnets arranged such that a specific magnetic polarity pattern is created. A detacher unit having the identical magnetic attracting or repelling polarity pattern is used to unlock the tag. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

Referring now to the drawing figures in which like reference designators refer to like elements, there is shown in FIG. 1 an exemplary configuration of a magnetic tag 10 used in accordance with the principles of the present invention. Tag 10 can be any security tag including a tag having electronic article surveillance ("EAS"), alarming, and/or radio frequency identification ("RFID") elements. FIG. 1 shows tag 10 having an attachment element 12 which is shown in FIG. 1 as a pin. Attachment element 12 secures tag 10 to an item, such as an article of clothing (not shown). If the item is removed from within a specified region, such as a retail store, without removal of tag 10, an alarm will be actuated signaling the unauthorized removal of the item. Attachment element 12 need not be a pin but can be any type of attachment device, such as a lanyard, a plunger or a plastic strap. Tag 10 includes a housing 11, and also includes a clamp 14 situated within a clamping region 13 in housing 11. EAS, RFID and/or alarming elements can be enclosed within the housing 11. Clamp 14 may be made of a magnetic material such as carbon steel or can be made of a non-magnetic material. Clamp 14 acts as a magnetic clutch and secures attachment element 12 within an attachment region 24, thus preventing the unauthorized separation of tag 10 from its item. Clamp 14 includes a locking region 16, a magnet location region 18, and a magnetic element 20. Spring 21 biases clamp 14 to allow retention of attachment element 12 and to allow return of clamp 14 to the locked position once the clamp has been unlocked. Although spring 21 is shown above clamp 14 so that operation of clamp 14 causes compression of spring 21, the invention is not limited to such. For example, it is contemplated that spring 21 can be placed below clamp 14 such that operation of claim 14 causes an expansion of spring 21.

Locking region 16 and magnet location region 18 pivot about a pivot point 22, which allows locking region 16 to move between a first position and a second position. When in the first position, locking region 16 engages a circumferential détente 25 in attachment element 12, thus locking attachment element 12 in place within attachment region 24 of tag 10. When locking region 16 is in the first position, attachment element 12, in this instance a pin, pierces the item, i.e., an article of clothing sandwiching the item between attachment element 12 and tag 10, which prevents the unauthorized separation of the item from tag 10. When magnet location region 18 moves in the direction of the arrow in FIG. 1, locking region 16 moves to a second position in the direction of the arrow and disengages with attachment element 12 thus allowing attachment element 12 to be withdrawn from attachment region 24 and the item separated from tag 10. Magnetic element 20 includes at least one hard magnet affixed to one side of magnet location region 18 as shown in FIG. 1.

FIG. 1 also shows a detaching unit 27 used to detach tag 10 from its article. Detaching unit 27 includes one or more magnets 29 and 31 such that when detaching unit 27 is placed proximate tag 10, magnets 29 and 31 are aligned with the magnets of magnetic element 20 of tag 10. Due to the repelling force between magnets having identical outwards-facing poles, magnet location region 18 is forced in the direction of the arrow which in turn forces locking region 16 to pivot about pivot point 22. This disengages locking region 16 from within circumferential détente 25, which allows attachment element 12 to be removed from tag 10. Thus, magnetic element 20 of tag 10 has a magnetic arrangement forming a "key". Detaching unit 27 must include magnets having the corresponding magnetic "key" in order to release attachment element 12 from tag 10.

Figure 2:
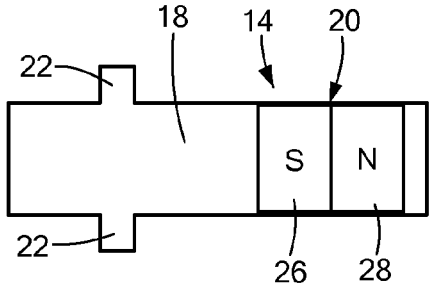
FIG. 2 is a bottom view of the clamp portion of the magnetic tag of FIG. 1.
Figure 3:
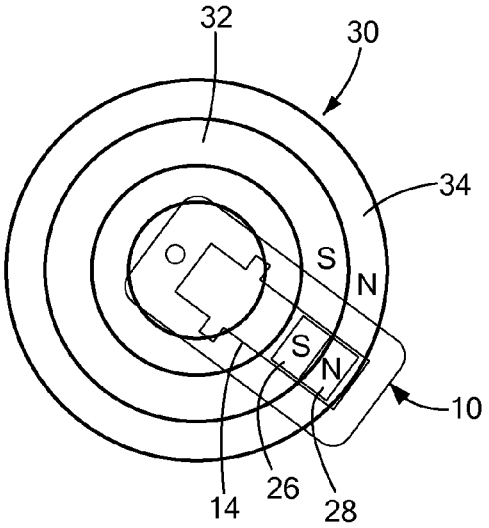
FIG. 3 is a top view showing the magnetic pattern of a magnetic tag detacher unit used to detach the magnetic tag of FIG. 1.

FIG. 2 is a bottom view of clamp 14 and shows an exemplary magnetic element 20. In one embodiment, magnet element 20 includes two magnets, a first magnet 26 having an outward-facing north magnet polarity and a second magnet 28 having an outward-facing south magnetic polarity. Thus, in one embodiment, magnetic element 20 used with clamp 14 includes two magnets 26 and 28 arranged with opposite poles in a side-by-side, coplanar fashion, as shown. Magnets 26 and 28 can be physically separate magnets which thereby form two magnet domains, e.g. a north pole and a south pole, or a single physical magnet having two magnet domains, e.g., the north pole and south pole orientation shown in FIG. 1 is established on a single physical magnet. By way of example, magnets of magnet element 20 can be made of bonded or sintered ceramic. The arrangement of magnets 26 and 28 shown in FIG. 2 is exemplary only and magnetic element 20 can include any number of magnets, arranged in any magnetic polarity pattern. Thus, the arrangement of magnets of magnetic element 20 forms a specific magnetic pattern or "key". Introduction of an identical magnetic pattern in a magnetic detacher will repel magnets 26 and 28 of magnetic element 20. In the embodiment of FIGS. 2 and 3, this repelling force will move body 18 in such a fashion that movable element 16 will pivot about pivot point 22 and will be dislodged from engagement with attachment element 12, thus allowing removal of attachment element 12 and freeing tag 10 from its item.

As discussed above, magnetic detaching unit 27 may be used to detach magnetic tag 10 from its item. Magnetic detaching unit 27 has one or more magnets forming a magnetic region. The magnets are arranged such that they form a specific keyed magnetic polarity pattern or combination. FIG. 3 shows an exemplary magnetic pattern 30 formed from a magnetic detaching unit 27 using concentric ring magnets. An inner ring magnet 32 has its magnetic north pole facing up, i.e., toward a tag placement region, while an outer ring 34 has its magnetic the south pole pointing facing up. In order to detach tag 10 from its item, tag 10 is placed above the magnetic detaching unit 27 in the tag placement region. In order to detach tag 10, magnets in detaching unit 27 are aligned with magnets in tag 10 such that identical poles are aligned. In this fashion, a repelling force is generated upon magnets 26 and 28, which forces body 18 of clamp 14 upwards, as shown in FIG. 1. This results in disengaging locking region 16 from attachment element 12 by moving the tip of locking region 16 away from circumferential détente 25 in attachment element 12. This will allow attachment element 12 to be removed from tag 10. The length of clamp 14 can vary according to preferred design thus allowing the amount of necessary detaching force and torque to be controlled.

The polarity arrangement shown in FIG. 3 is exemplary only. For example, in certain instances, e.g., when the magnet arrangement of tag 10 is different than what is shown in FIGS. 1 and 2, the outer ring may have an upward facing north magnetic polarity and the inner ring may have an upwards facing south magnetic polarity. The magnetic pattern of the detacher is designed to apply the requisite repelling force needed to unlock clamp 14. Further, since the number of magnets in magnetic element 20 can be greater than two, additional rings may be needed in the detacher's magnetic pattern. For example, if clamp 14 included a magnetic element 20 having 5 magnets having a keyed magnetic pattern or "key" of N-N-S-N-S, then the keyed magnetic pattern formed by the magnetic detacher would have an identical magnetic pattern in order to repel the magnets of clamp 14 and force locking region 16 to move away from attachment element 12. Thus, the present invention is not limited to a specific number of magnets used in clamp 14 or to a specific magnetic ring pattern formed by the magnetic detacher. In this fashion, the present invention advantageously prevents a shoplifter from detaching tag 10 from its item by simply using a large enough magnet upon tag 10. The shoplifter would have to know the precise magnetic pattern formed by magnetic element 20 and design a detacher having this exact pattern.

In an alternate embodiment, tag 10 includes magnetic element 20 having two or more magnets sized in a fashion such that the housing of tag detacher 27 can be designed so tag 10 can only fit within detacher 27 in one way in order to assure the proper alignment of the magnets. In this fashion, if a shoplifter uses his or her own detacher 27 in an attempt to detach tag 10 from its item, the necessary unlocking force or torque cannot be generated, since the force created from one-magnet will be cancelled by the other due to opposing poles. In addition, such a magnetic configuration provides a repelling force that is responsible for unlocking clamp 14. This is different from typical magnetic detaching mechanisms, which rely on the magnetic attraction between the detacher and the locking mechanism. Further, even if a shoplifter was clever, could obtain and assemble concentric ring magnets and knew there was a ring arrangement, the shoplifter would still have to know the exact arrangement of the magnets in order to successfully remove attachment element 12 from tag 10.

As discussed above, a large number of magnetic pole configurations can be incorporated into clamp 14 of tag 10 based on the number, size, and location of the poles. By varying the magnetic pole configuration, it makes it extremely difficult for a shoplifter to unlock tag 10 without prior knowledge of the magnet configuration. Further, the present invention allows tag 10 to be substantially co-planar (0 degrees) with clamp 14. This will provide maximum torque and allow tag designers to design tags 10 having a more stream-lined, aesthetic appearance.

Figure 4:
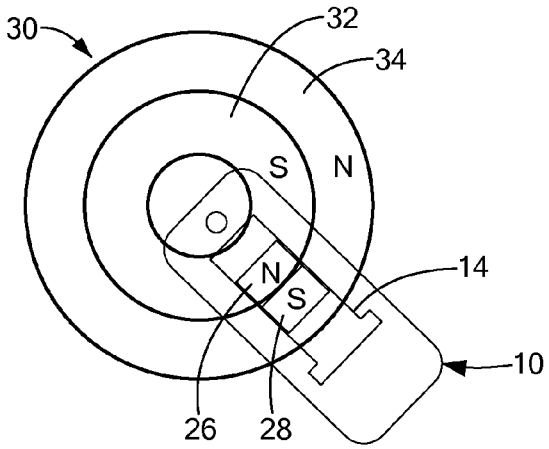
FIG. 4 is a top view of an alternate embodiment of the present invention.

FIG. 4 shows a magnetic tag detacher pattern 30 having two concentric ring magnets where the inner ring magnet 32 has an upward facing north magnetic polarity and the outer ring magnet 34 has an upward facing south magnetic polarity. A detacher having this magnetic polarity pattern can be used to detach magnetic tag 10 through mutual attraction rather than by a repelling force as described above and shown in FIGS. 1-3. FIG. 4 shows two magnets 26 and 28 within clamp 14 of tag 10. Clamp 14 is placed over the concentric ring configuration 30 of the magnetic detacher. In this instance, since the north magnetic polarity of magnet 26 is directly above the south magnetic polarity of inner ring 32 and the south magnetic polarity of magnet 28 is directly above the north magnetic polarity of outer ring 34, there is an attraction force that pulls clamp 14 in a downward direction, i.e., toward the tag placement region of detaching unit 27.

Figure 5:
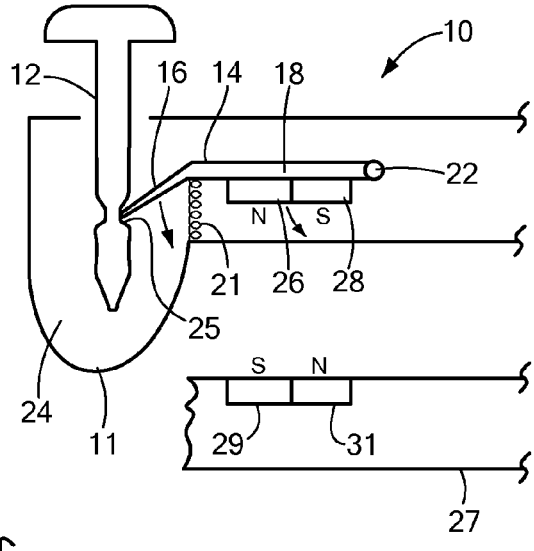
FIG. 5 is a side view of the alternate embodiment of FIG. 4.

FIG. 5 illustrates how the magnets of detaching unit 27 and the magnets of magnetic element 20 of tag 10 can be arranged to provide attractive forces to unlock clamp 14. FIG. 5 is a side view of the embodiment discussed above and shown in FIG. 4. In the embodiment shown in FIGS. 1 and 2, a repelling force is applied to magnets 26 and 28 of magnet element 20 and serves to pull clamp 14 downward in the direction shown in FIG. 5, i.e., toward the tag placement region of detaching unit 27. In the embodiment shown in FIGS. 4 and 5, pivot point 22 is now located at one end of clamp 20 rather than between locking region 16 and magnet location region 18 as in the configuration shown in FIG. 1, and the magnets 26 and 28 or magnetic element 20 are reversed. Further, spring 21 is situated proximate the point where locking region 16 joins magnet location region 18. Thus, when attractive forces act upon clamp 14 due to the magnet arrangement shown in FIG. 4, e.g., the attraction of opposite poles, magnet location region 18 is pulled downward as shown by the arrow in FIG. 5. This force compresses spring 21, which moves locking region 16 away from attachment element 12 as shown by the arrow, thereby allowing tag 10 to be detached from the protected item.

Figure 6:
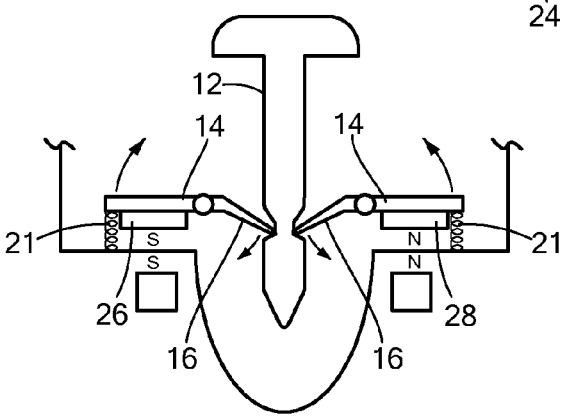
FIG. 6 is side view of yet another embodiment of the present invention.

FIG. 6 illustrates another embodiment of the present invention where two clamps 14 are placed on either side of the attachment element 12. Affixed to one of the clamps 14 is a magnet 26 with an outward-facing southern polarity and affixed to the other clamp 14 is a magnet 28 with an outward-facing northern polarity, as shown. If a detacher having uniform pole magnetization is used, e.g., two magnets having the same polarity, only one of clamps 14 is disengaged from attachment element 12 while the other clamp remains engaged with attachment element 12. The result is that attachment element 12 remains locked within tag 10. On the other hand, a detacher having an identical magnetization configuration as shown in FIG. 6 applies an upward force upon clamps 14 as shown by the arrows. This, in turn, swings movable elements 16 down, which disengages movable elements 16 from their engagement with attachment element 12. The configuration of FIG. 6 is exemplary only and only serves to illustrate that multiple clamps 14 and multiple magnetic patterns can be designed such that only a detacher having an identical magnetic pattern arrangement can successfully unlock tag 10. Thus, the present invention can utilize either repelling or attractive magnetic forces, and can incorporate one or more clamps 14 in order to design a tag detaching system that prevents unauthorized unlocking of magnetic tag 10.

Figure 7:
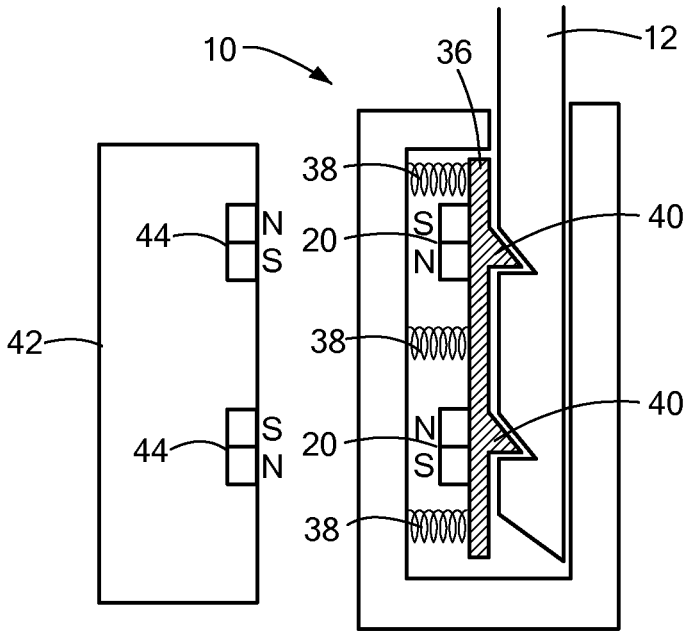
FIG. 7 is a cut away view of a spring loaded magnetic clamp incorporated into a magnetic tag.

FIG. 7 shows another embodiment of the tag detacher system of the present invention. In this embodiment, tag 10 includes a spring-loaded locking mechanism 36 with two sets of magnet elements 20. In this embodiment, magnetic element 20 includes two magnets, although the number of magnets used can vary. Three springs 38 apply force upon locking mechanism 36. This force secures attachment element 12 within tag 10 due to the engagement of two prongs 40 within corresponding grooves within attachment element 12, as shown. In order to secure engagement of attachment element 12 within tag 10, a detacher 42 that includes magnet assembly 44, is positioned under tag 10 such that magnet assembly 44 are aligned with magnet elements 20. The polarities of the magnets of magnet assembly 44 are opposite the polarities of the magnets of magnet elements 20. The attractive force between the magnets of magnet assembly 44 and the magnets of magnet elements 20 withdraw prongs 40 of locking mechanism 36 from within corresponding grooves of attachment element 12, compresses springs 38, and allows attachment element 12 to be withdrawn from tag 10.

Figure 8:
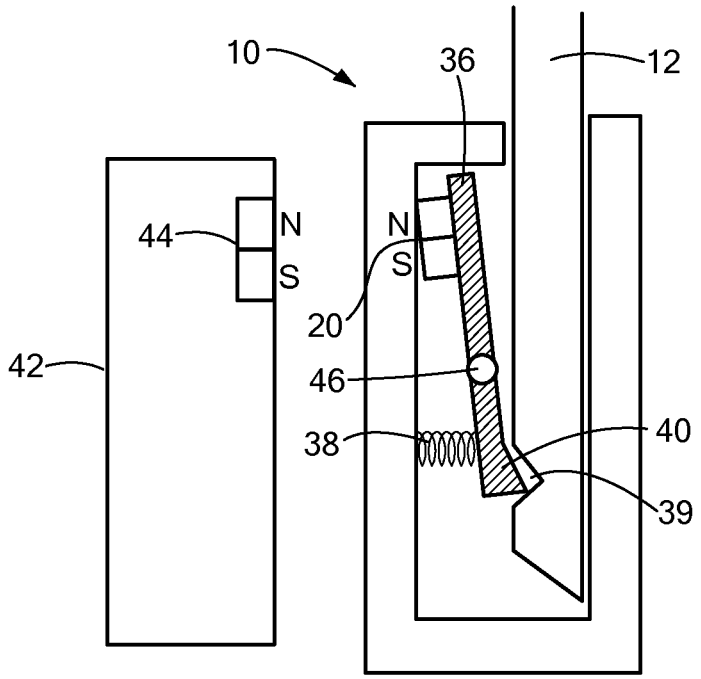
FIG. 8 is an alternate embodiment of the spring loaded magnetic clamp of FIG. 7.

FIG. 8 illustrates yet another embodiment of the present invention. In this embodiment, locking mechanism 36 includes a hinge 46 in locking mechanism 36. Magnetic element 20 is situated toward one end of locking mechanism 36. When tag 10 is positioned over detacher 42, magnets of magnet assembly 44 having identical polarities to the magnets of magnetic element 20 generate a repelling force that forces the top end of locking mechanism 36 toward attachment element 12. This allows locking mechanism 36 to pivot about hinge 46, which compresses spring 38. As spring 38 is compressed, prong 40 is withdrawn from within the groove 39 of attachment element 12 thus releasing attachment element 12 from tag 10.

Figure 9:
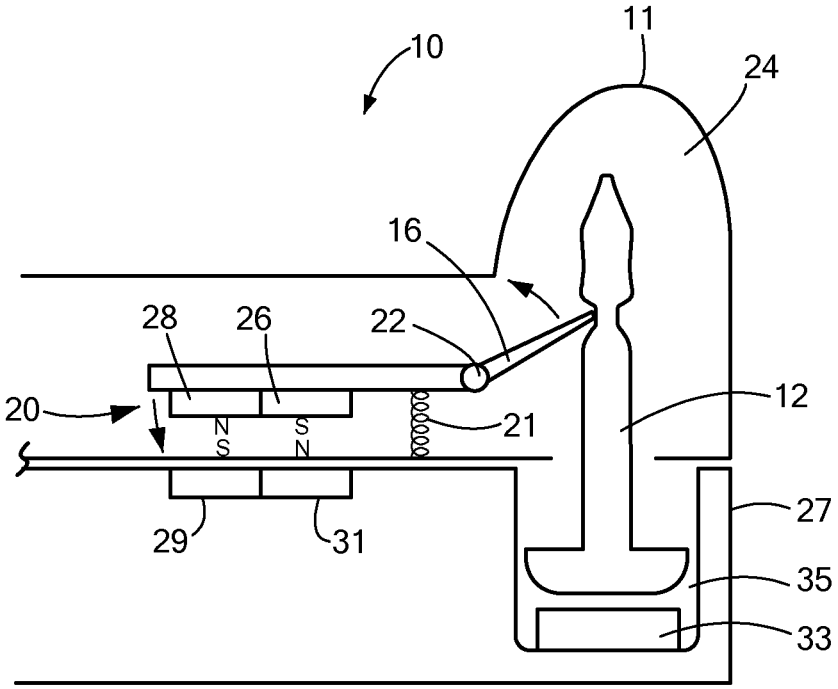
FIG. 9 is yet another embodiment of a magnetic tag constructed in accordance with the principles of the present invention.

FIG. 9 illustrates yet another embodiment of the present invention. In a typical retail operation, once a transaction is completed, the operator puts tag 10 on detaching unit 27 and has to manually remove attachment element 12, e.g., a pin or lanyard, with one hand while holding tag 10 with another. In the embodiment shown in FIG. 9, both tasks can be accomplished with a single hand. To accomplish this, a mechanism to capture the attachment element, e.g., pin 12, is integrated into detaching unit 27. In addition, clamp 14 is unlocked before pin 12 is captured. Otherwise, the locking mechanism may jam. To accomplish this, detaching unit 27 includes an unlocking mechanism, which is supported by a spring loaded platform (not shown). Detaching unit 27 also includes a pin capturing magnet 33 which is located within a recess 35 of detacher unit 27. In operation, tag 10 is placed, pin-down, into detaching unit 27. Clamp 14 is unlocked as tag 10 is positioned in the manner described above in earlier embodiments, i.e., positioned to align magnets 26 and 28 in tag 10 with corresponding magnets 29 and 31 in detaching unit 27. The operator activates detaching until 27, causing pin 12 to be captured by pin capturing magnet 33. It is presumed that a portion of pin 12 has magnetic properties which allow it to be attracted to capturing magnet 33. Then, tag 10 can be removed from the protected article.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A magnetic clamping device for securing an attachment element to an item, the device comprising:

a clamp movable between a locked position and an unlocked position;

a keyed magnetic element affixed to the clamp, the keyed magnetic element having a predefined arrangement of magnetic domains including at least a first magnetic domain and a second magnetic domain of opposite polarity than the first magnetic domain; and the keyed magnetic element being configured to move the clamp from the locked position to the unlocked position when a keyed magnetic force corresponding to the keyed magnetic element is applied to the keyed magnetic element.

2. The magnetic clamping device of claim 1, wherein the clamp is movable about a pivot point such that when the keyed magnetic element is exposed to the keyed magnetic force corresponding to the keyed magnetic element, the clamp pivots about the pivot point from the locked position to the unlocked position.

3. The magnetic clamping device of claim 2, wherein the clamp further comprises a locking region such that when the keyed magnetic element is exposed to the keyed magnetic force corresponding to the keyed magnetic element, the locking region pivots about the pivot point from the locked position to the unlocked position.

4. The magnetic clamping device of claim 1, wherein the clamp is maintained in the locked position by at least one spring.

5. The magnetic clamping device of claim 1, wherein the clamp is made of a magnetic material.

6. The magnetic clamping device of claim 1, wherein the clamp is made of carbon steel.

7. The magnetic clamping device of claim 1, wherein the keyed magnetic element forms a first magnetic polarity pattern; and when the keyed magnetic element is exposed to a second magnetic polarity pattern opposite the first magnetic polarity pattern, the clamp moves from the locked position to the unlocked position.

8. The magnetic clamping device of claim 7, wherein the keyed magnetic element forms a first magnetic polarity pattern; and when the keyed magnetic element is exposed to a second magnetic polarity pattern identical to the first magnetic polarity pattern, the clamp moves from the locked position to the unlocked position.

9. A security tag comprising:

an attachment element;

a housing having an attachment region and a clamping region, the attachment region adapted to receive at least a portion of the attachment element;

a clamp within the clamping region, the clamp movable between a locked position and an unlocked position;

a keyed magnetic element disposed within the housing and affixed to the clamp, the keyed magnetic element having a predefined arrangement of magnetic domains including at least a first magnetic domain and a second magnetic domain of opposite polarity than the first magnetic domain; and the keyed magnetic element being configured to move the clamp from the locked position to the unlocked position when a keyed magnetic force corresponding to the keyed magnetic element is applied to the keyed magnetic element.

10. The security tag of claim 9, wherein the clamp is movable about a pivot point such that when the keyed magnetic element is exposed to the keyed magnetic force corresponding to the keyed magnetic element, the clamp pivots about the pivot point from the locked position to the unlocked position.

11. The security tag of claim 10, wherein the clamp further comprises a locking region such that when the keyed magnetic element is exposed to the keyed magnetic force corresponding to the keyed magnetic element, the locking region pivots about the pivot point from the locked position to the unlocked position.

12. The security tag of claim 9, further comprising at least one spring, wherein the clamp is maintained in the locked position by the at least one spring.

13. The security tag of claim 9, wherein the clamp is made of a magnetic material.

14. The security tag of claim 9, wherein the keyed magnetic element forms a first magnetic polarity pattern; and when the keyed magnetic element is exposed to a second magnetic polarity pattern opposite the first magnetic polarity pattern, the clamp moves from the locked position to the unlocked position.

15. The security tag of claim 14, wherein the keyed magnetic element forms a first magnetic polarity pattern; and when the keyed magnetic element is exposed to a second magnetic polarity pattern identical to the first magnetic polarity pattern, the clamp moves from the locked position to the unlocked position.

16. The security tag of claim 9, further comprising an electronic article surveillance ("EAS") component enclosed within the housing.

17. The security tag of claim 9, further comprising a radio frequency identification ("RFID") component enclosed within the housing.

18. The security tag of claim 9, further comprising an alarming element enclosed within the housing.

19. A security system comprising:

a security tag, the security tag comprising:

a clamping device, the clamping device comprising:

a clamp movable between a locked position and an unlocked position; and a keyed magnetic element affixed to the clamp, the keyed magnetic element having a magnetic polarity pattern including at least a first magnetic domain and a second magnetic domain of opposite polarity than the first magnetic domain, the keyed magnetic element being configured to move the clamp from the locked position to the unlocked position; and a tag detacher, the tag detacher including a magnetic region, the magnetic region applying a keyed magnetic force corresponding to the keyed magnetic element to the keyed magnet element, the magnetic force causing the keyed magnetic element to move the clamp from the locked position to the unlocked position.

20. The security system of claim 19, wherein:

the security tag further includes an attachment element, at least a portion of the attachment element being comprised of a magnetic material, the attachment element being removably lockable by the clamp; and the tag detacher further includes:

a recess; and a capture magnet proximate the recess, the capture magnet arranged to attract the portion of the attachment element to retain at least a portion of the attachment element within the recess.

* * * * *